US009814292B2

(12) United States Patent
Tittas et al.

(10) Patent No.: US 9,814,292 B2
(45) Date of Patent: Nov. 14, 2017

(54) EPILATOR HAVING A MASSAGE ROLLER

(75) Inventors: Christina Dorothea Tittas, Wachtersbach (DE); Ingo Mueller, Klagenfurt (AT); Harald Duller, Griesgasse (AT)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 909 days.

(21) Appl. No.: 12/995,686

(22) PCT Filed: Jun. 9, 2009

(86) PCT No.: PCT/IB2009/052437

§ 371 (c)(1),
(2), (4) Date: Dec. 2, 2010

(87) PCT Pub. No.: WO2009/150607

PCT Pub. Date: Dec. 17, 2009

(65) Prior Publication Data

US 2011/0077665 A1 Mar. 31, 2011

(30) Foreign Application Priority Data

Jun. 12, 2008 (EP) ..... 08158089

(51) Int. Cl.
*A45D 26/00* (2006.01)
*A61H 15/00* (2006.01)

(52) U.S. Cl.
CPC .. *A45D 26/0061* (2013.01); *A61H 2015/0014* (2013.01)

(58) Field of Classification Search
CPC ..... A45D 26/0061; A45D 26/0023; A45D 26/0028; A61H 2015/0014
USPC .... 606/131, 133; 601/46, 52, 122, 119, 120, 601/112, 121, 125
See application file for complete search history.

(56) References Cited

U.S. PATENT DOCUMENTS

| | | | | |
|---|---|---|---|---|
| 1,569,426 | A * | 1/1926 | Krauthoff | 601/125 |
| 2,952,907 | A | 9/1960 | Miller | |
| D337,827 | S * | 7/1993 | Seng | D24/211 |
| 5,810,843 | A | 9/1998 | Iwasaki et al. | |
| 6,004,331 | A * | 12/1999 | Takeuchi et al. | 606/133 |
| 6,520,970 | B1 | 2/2003 | Sanchez-Martinez | |
| 6,740,097 | B1 * | 5/2004 | Sanchez-Martinez | 606/133 |
| 7,211,090 | B2 | 5/2007 | Kreutz et | |
| 8,142,376 | B2 * | 3/2012 | Gueret | 601/122 |

FOREIGN PATENT DOCUMENTS

| | | | |
|---|---|---|---|
| CN | 2294724 | Y | 10/1998 |
| CN | 2346429 | Y | 11/1999 |
| DE | 102005061539 | A1 | 7/2007 |
| EP | 1582112 | A1 | 10/2005 |
| FR | 2810516 | A1 | 12/2001 |
| JP | 2001008726 | A | 1/2001 |
| JP | 2003225273 | A | 8/2003 |

(Continued)

*Primary Examiner* — Gregory Anderson
*Assistant Examiner* — Sarah Simpson

(57) ABSTRACT

An epilator includes an epilation head and a massage roller arranged next to the epilation head. The massage roller is rotatable about a longitudinal axis and includes pairs of elementary massaging members positioned in a V-shape relative to each other. Each elementary massaging member may be a round, elliptical, or polygonal disc.

16 Claims, 8 Drawing Sheets

(56) References Cited

FOREIGN PATENT DOCUMENTS

| | | | |
|---|---|---|---|
| WO | 9421210 | A1 | 9/1994 |
| WO | 02056724 | A1 | 7/2002 |
| WO | 2006035363 | A1 | 4/2006 |

* cited by examiner

Section C - C

Section B - B

Section B - B

EPILATOR HAVING A MASSAGE ROLLER

FIELD OF THE INVENTION

The invention relates to an epilator comprising an epilation head and a massage roller arranged next to the epilation head, wherein the massage roller is rotatable about a longitudinal axis.

BACKGROUND OF THE INVENTION

Hand-held, motor-driven epilators have become increasingly popular in recent years. Such epilators generally comprise pairs of cooperating clamping discs or other mechanisms for extracting hairs from skin.

Epilation can be quite a painful procedure. However, it has been found that the pain can be significantly reduced by stimulating nerves in the skin immediately before hairs are extracted from the skin. Today a multiplicity of epilators having a massage, vibration or other pain-reducing device are available. Such devices can be passive, or they can be actively driven by a motor, e.g. by the motor which also drives the clamping discs. Experiments have shown that the amount of pain reduction that is achieved by massaging or vibrating members varies from one user to another and is also quite dependent on the specific nature of the massaging and/or vibrational stimuli.

U.S. Pat. No. 6,520,970 B1 and U.S. Pat. No. 6,740,097 B1, respectively, describe sets of rotatable gear wheels and spiked cylinders which are rotatably arranged next to the clamping discs, for stimulating nerves in the skin prior to the removal of hair.

It is an object of the invention to provide an epilator having a pain-reducing element for providing particular stimuli to the skin.

SUMMARY OF THE INVENTION

According to the invention, the massage roller comprises pairs of elementary massaging members positioned in a V-shape relative to each other. The massage roller thus has a unique and easily identifiable geometrical shape which is apt to generate particular neural stimuli in the skin prior to, during, or after the removal of hair. The characteristic shape in particular implies that the instantaneous skin contact surface, i.e., the part of the roller's surface which at one particular moment touches the skin, varies considerably as the roller is rolled on the skin.

The elementary massaging members may be arranged in a row along the longitudinal axis. Thereby a particularly simple geometrical shape is achieved.

Each elementary massaging member may be a round, elliptical, or polygonal disc. Depending on these shapes, different neural stimuli are generated in the skin. The disc may in particular be elliptical, with the ratio of the ellipse's minor axis to the ellipse's major axis lying in the range of 0.8 to 0.99, and preferably between 0.9 and 0.96. The massaging member may in particular be a triangular, tetragonal, pentagonal or hexagonal disc.

In this context, a normal axis of each disc and the longitudinal axis may enclose an angle between 5 degrees and 85 degrees. Thereby a particularly convenient geometric shape is achieved.

The pairs may be arranged in positions which are mutually rotated about the longitudinal axis. Thus a more complex geometrical shape is achieved, possibly provoking more intense stimuli on the skin.

It may be particularly advantageous that the pairs are arranged in positions which are mutually rotated about the longitudinal axis, with a mutual angle of rotation of 90 degrees. Thus a particularly abrupt transition from one pair to the neighboring pair is achieved.

A skin contact surface of each elementary massaging member may be smooth. Thus the stimuli on the skin are determined by the massage roller's shape rather than by its small-scale surface structure. The skin contact surface may in particular be devoid of any spikes or nibbles. This ensures that the roller safely rolls on the skin without causing discomfort or injury.

Each elementary massaging member may have an instantaneous skin contact surface, an axial extension of which varies as the roller is rolled across the skin. This is achieved by each elementary massaging member having a circumference having a non-uniform axial extension. Herein "axial" refers to the massage roller's longitudinal axis, unless specified otherwise. The axial extension of an object is defined as the object's projection on the massage roller's longitudinal axis, unless specified otherwise.

The instantaneous skin contact surface may be non-vanishing. Thus each elementary massaging member remains in direct physical contact with the skin as the massage roller is rolled across the skin.

A projection of the massage roller on a plane containing the longitudinal axis may be wave-shaped or zig-zag-shaped. Hence the massage roller is markedly asymmetric with regard to rotations about the longitudinal axis.

The massage roller may be an injection moulded piece or it may comprise a rigid inner structure covered by an elastic material. An injection moulded piece can be particularly robust and also exhibit a certain degree of elasticity. Alternatively, the roller may, for example, comprise a metal shaft for engaging with a bearing, and a rubber coating for contacting the skin.

The epilator may comprise a reversibly detachable cap surrounding a portion of the epilation head, wherein the massage roller is mounted to the cap. Thus the massage roller may be removed from the epilator together with the detachable cap. For example, the cap carrying the massage roller may be replaced by a different cap providing an alternative form of skin treatment.

The massage roller may be spring-biased toward the skin. In other words, the epilator may comprise a spring for exerting a mechanical force on the massage roller such that the latter remains in firm contact with the skin as the epilator is moved across the skin. The epilator may comprise a driving mechanism for driving the massage roller. For example, the massage roller may be driven to perform forced vibrations, e.g. in the form of a fast oscillatory up-and-down movement of the massage roller relative to the skin. In particular, the massage roller may be driven by the same electric motor that also drives the clamping discs. To this end, a gear mechanism may be provided between the motor and the massage roller.

The massage roller may be reversibly detachable from the epilator. Thus the massage roller may be removed from the epilator by the user, for example for cleansing or for replacement.

These and other features of the invention will become apparent from the following description and the accompanying drawings.

DESCRIPTION OF PREFERRED EMBODIMENTS

Figure 1:
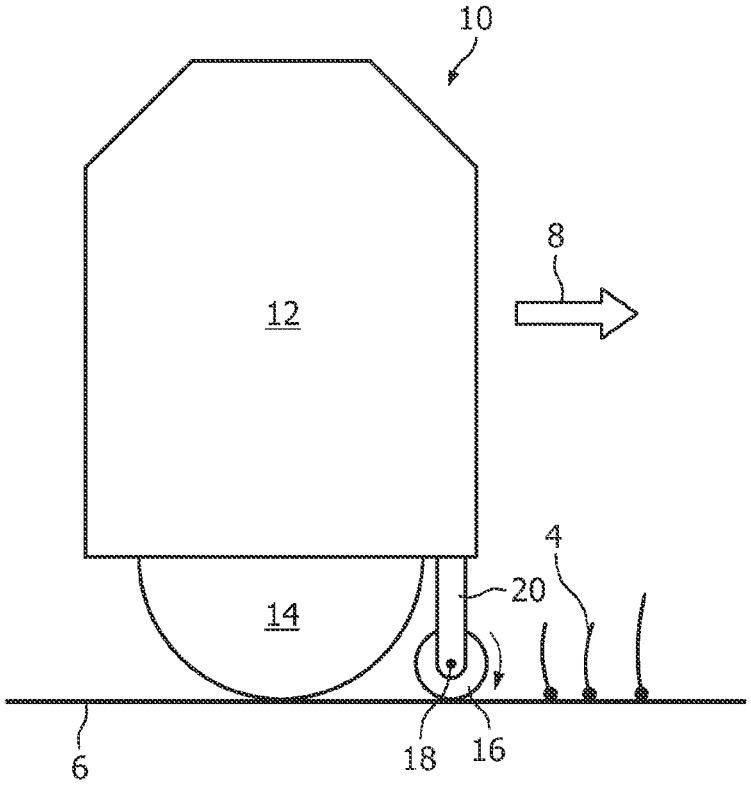
FIG. 1 is a simplified side view of an epilator comprising a massage roller.

The same reference numerals are used in different Figures to designate identical, similar or analogous components. Such components are not necessarily described more than once.

FIG. 1 shows a simplified side view of an epilator 10 comprising a housing 12, an epilation head 14, and a massage roller 16 rotatably mounted to the housing 12 by means of an axle 18 and a bearing 20. The massage roller 16 is arranged ahead of the epilation head 14 with regard to the direction of movement 8. Thus, when the epilator 10 is moved over the skin, the massage roller 16 stimulates nerves in the skin 6 before the epilation head 14 extracts hair 4 from the skin 6. Additionally or alternatively, the epilator 10 may comprise a massage roller (not shown) identical or similar to the massager roller 16 but arranged behind the epilation head so that nerves in a specific portion of the skin 6 are stimulated after the epilation head 14 has moved over that portion of the skin. The housing 12 comprises a motor (not shown), for example an electrical motor or a wind-up motor, for rotating clamping discs (not shown) of the epilation head 14. The same motor could also be used to drive the massage roller 16. However, in the embodiment shown, the massage roller 16 is rotated on the skin by means of friction with the skin as the epilator is moved in the direction of movement 8, provided the epilator 10 is pressed sufficiently firmly against the skin 6.

Figure 2:
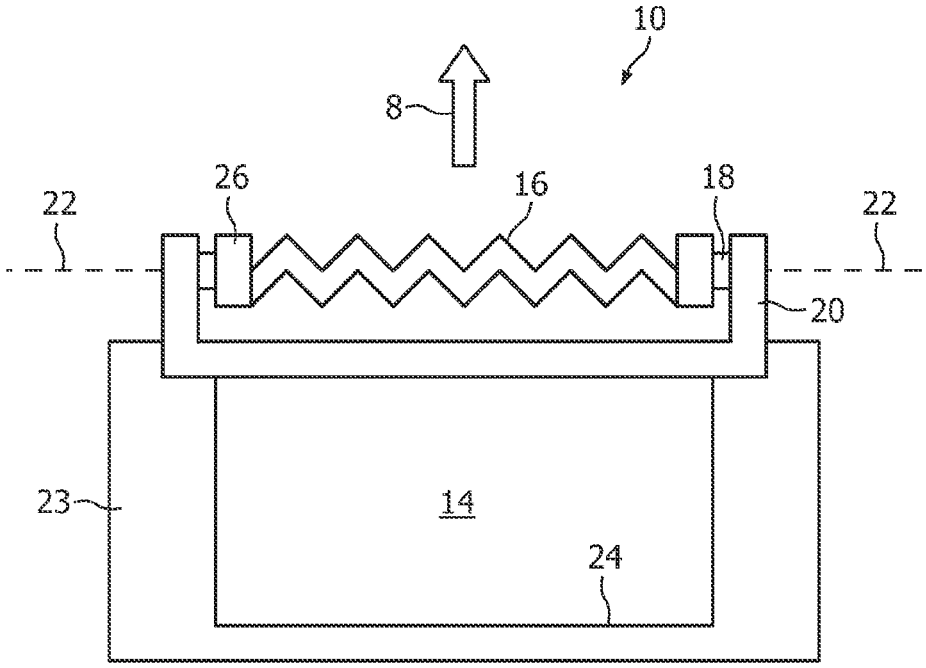
FIG. 2 is a simplified bottom view of an epilator comprising a massage roller.
Figure 3:
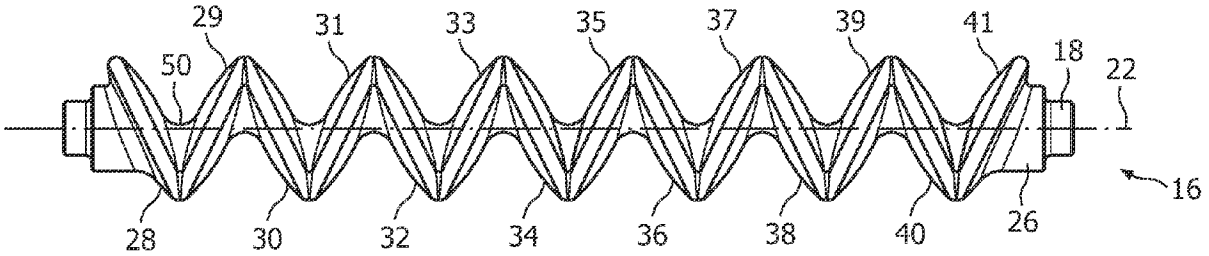
FIG. 3 is a front view of a massage roller according to a first embodiment.
Figure 4:
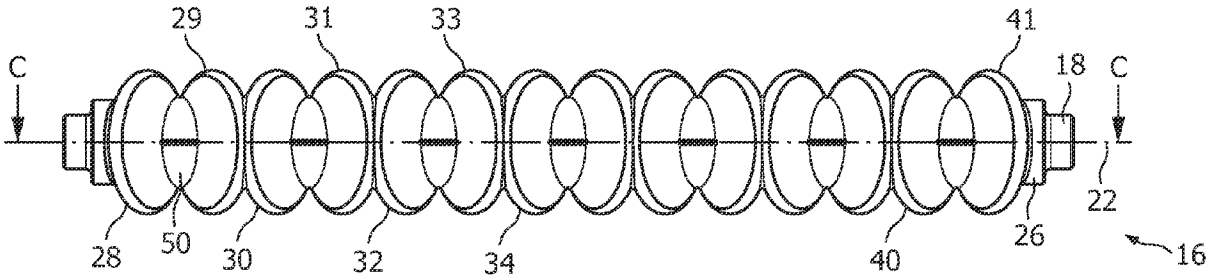
FIG. 4 is a front view of the massage roller shown in FIG. 3, rotated through 90° about its longitudinal axis.
Figure 5:
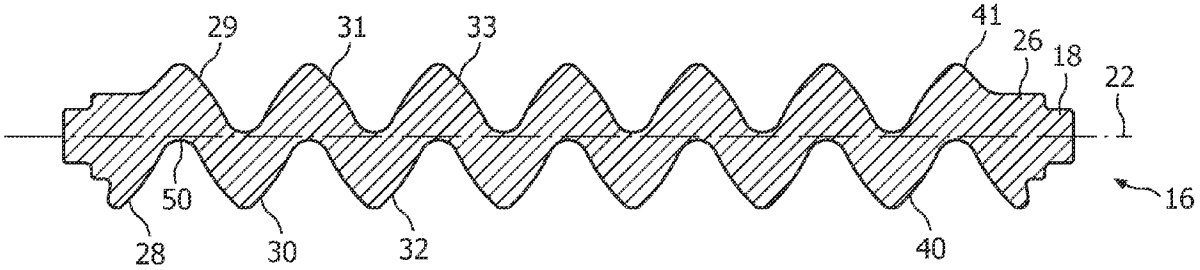
FIG. 5 illustrates a longitudinal cross section of the massage roller shown in FIG. 3.

FIG. 2 shows a simplified bottom view of an epilator 10 similar to the epilator discussed above with reference to FIG. 1. The epilation head 14 of the epilator 10 is surrounded by a cap 23 attached to the housing 12 (not visible). The cap 23 defines a treatment window 24 through which the epilation head 14 may contact the skin 6. Mounted to the cap 23 is a bearing 20 for holding a shaft 18 that is in one piece with the massage roller 16. The massage roller 16 has a substantially wave-shaped or zig-zag-shaped projection on a plane containing the rotational axis 22. The massage roller 16 also comprises, at each end, a shoulder 26 for joining the shaft 18 to the zig-zag-shaped or wave-shaped portion of the massage roller 16. The bearing 20 is attached to the cap 23 by means of screws or a snap mechanism (not shown).

Figure 6:
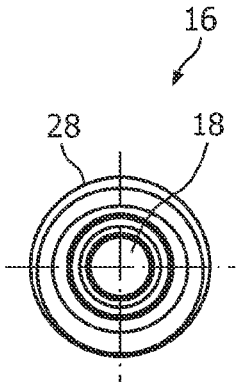
FIG. 6 is a side view of the massage roller shown in FIG. 3.
Figure 7:
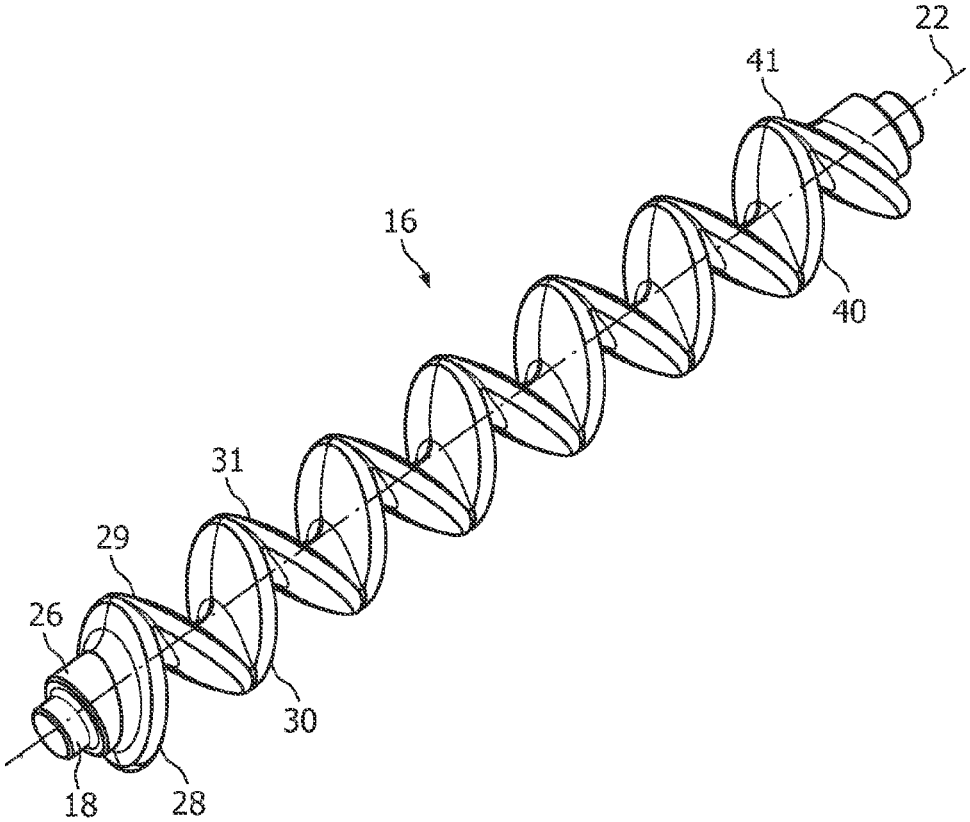
FIG. 7 is an oblique view of the massage roller shown in FIG. 3.
Figure 8:
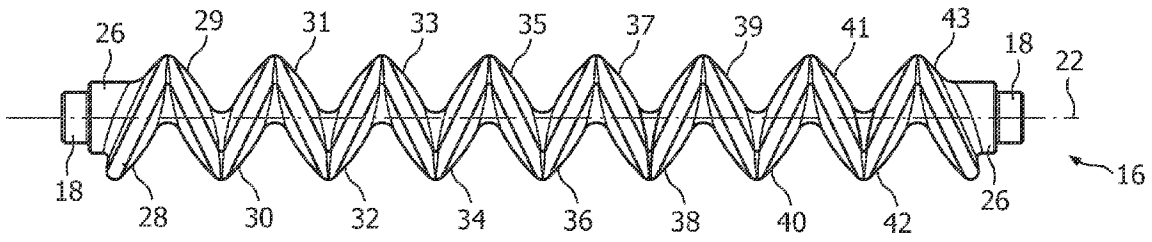
FIG. 8 is a front view of a massage roller according to a second embodiment.
Figure 9:
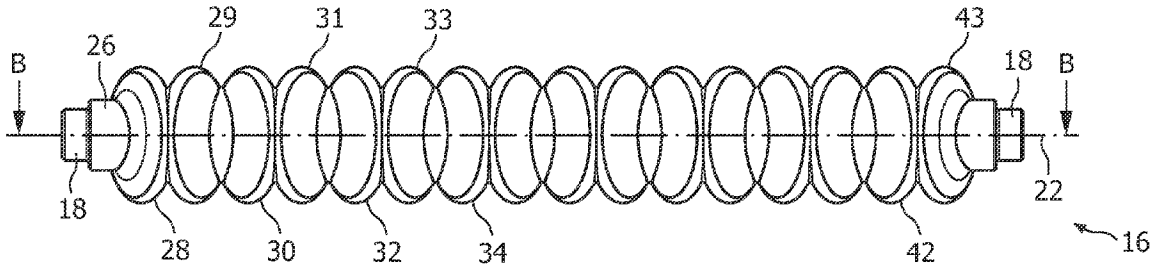
FIG. 9 is a front view of the massage roller shown in FIG. 8, rotated through 90° about its longitudinal axis.
Figure 10:
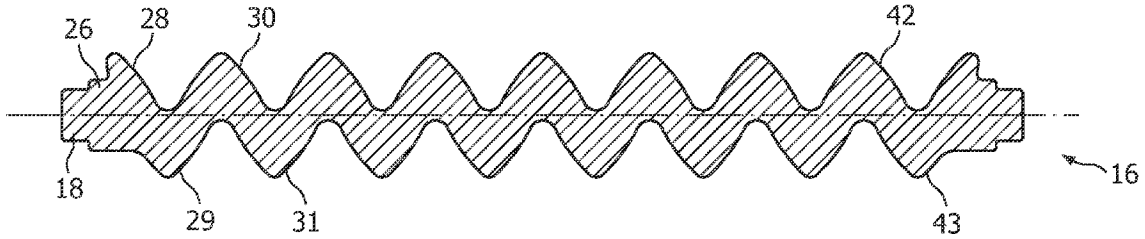
FIG. 10 illustrates a longitudinal cross section of the massage roller shown in FIG. 8.
Figure 11:
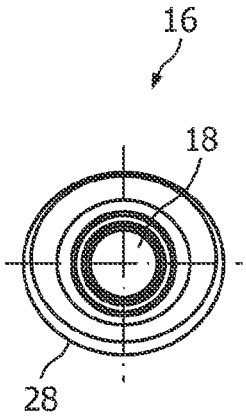
FIG. 11 is a side view of the massage roller shown in FIG. 8.
Figure 12:
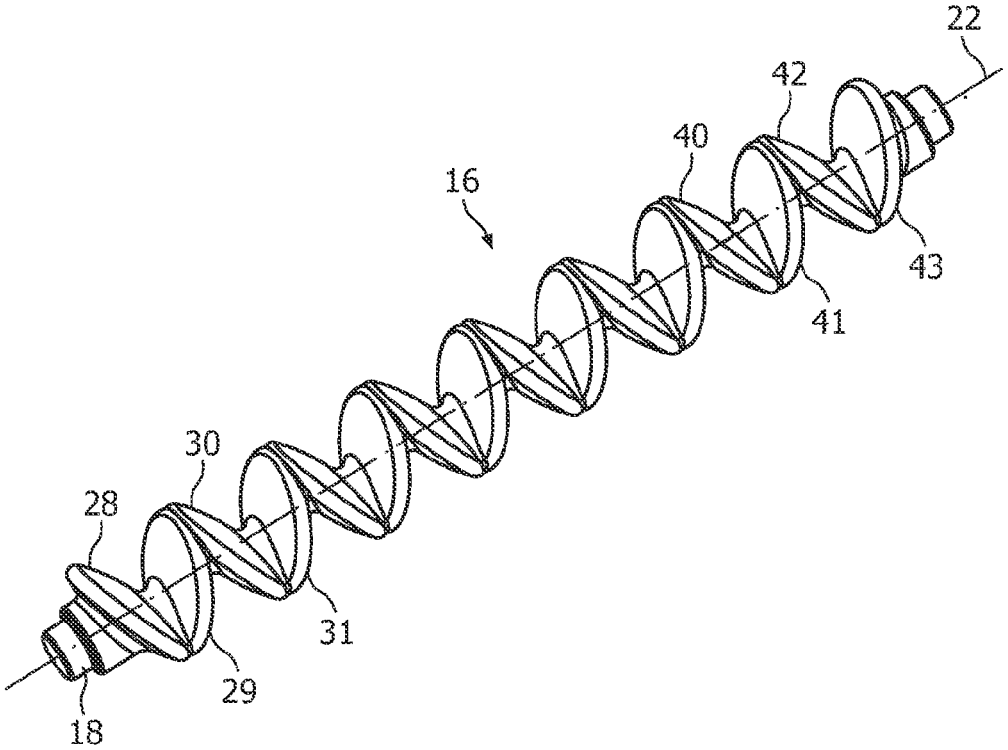
FIG. 12 is an oblique view of the massage roller shown in FIG. 8.
Figure 13:
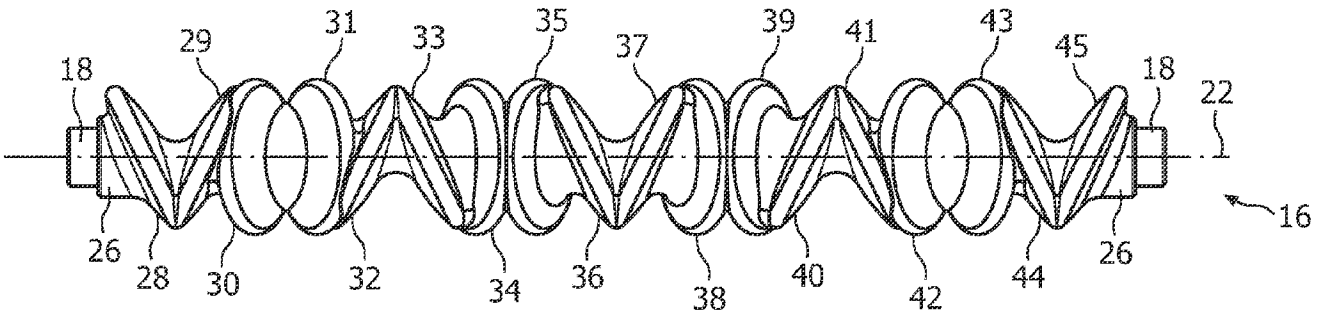
FIG. 13 is a front view of a massage roller according to a third embodiment.
Figure 14:
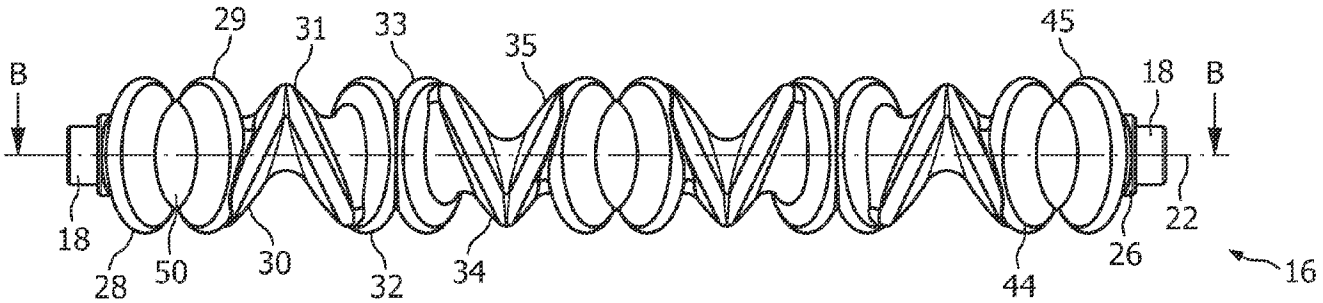
FIG. 14 is a front view of the massage roller shown in FIG. 13, rotated through 90° about its longitudinal axis.
Figure 15:
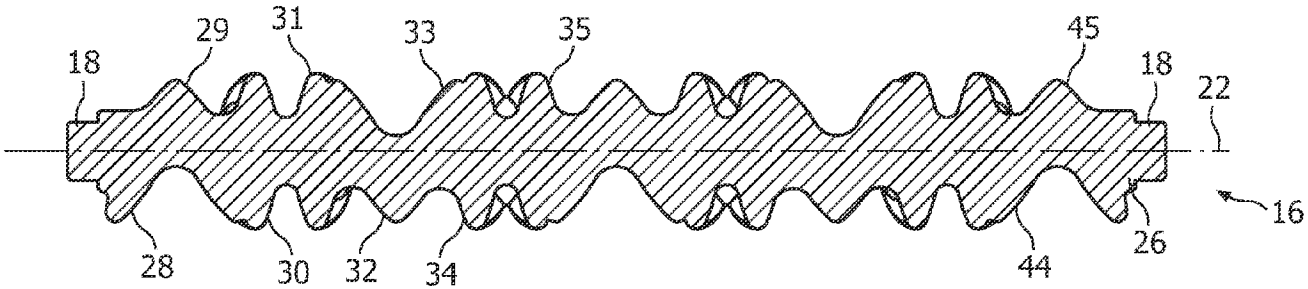
FIG. 15 illustrates a longitudinal cross section of the massage roller shown in FIG. 13.

Referring now to FIGS. 3 to 7, there is illustrated in greater detail a first embodiment of a massage roller 16. The massage roller 16 has a longitudinal axis 22 and comprises pairs 28-29, 30-31, 32-33, 34-35, 36-37, 38-39, 40-41 of elementary massaging members 28 to 41 positioned in a V-shape relative to each other. The elementary massaging members 28 to 41 are arranged in a row along the longitudinal axis 22. Each of the elementary massaging members 28 to 41 is a disc having a round cross section and a substantially oval or elliptical side. The normal axis of each disc (i.e. an axis perpendicular to the round cross section of the disk) and the massage roller's longitudinal axis may define an angle of around 45°. The first elementary massaging member 28 and the last elementary massaging member 41, situated at opposite ends of the massage roller 16, are each joined to a shaft 18 by means of a shoulder 26 having an enlarged diameter. Arranged between adjoining elementary massaging members, e.g. 28 and 29, is a saddle 50 for increasing the mechanical robustness of the massage roller 16. As is best seen in FIG. 6, the massage roller 16 has a circular projection on a plane perpendicular to the longitudinal axis 22. The projection of each elementary massaging member, e.g. the massaging member 28, on a plane perpendicular to the longitudinal axis has a diameter of around 5 mm. As the massage roller 16 is rolled on the skin, each of its elementary massaging members 28 to 41 permanently remains in contact with the skin. The massage roller 16 may be reversibly detachable from the epilator (not shown in the Figure) by means of a snap mechanism. This mechanism may be provided by the two shafts 18 and complementary bearings (not shown) of the epilator. The complementary bearings, or the massage roller 16, or both, may be elastic, so that the massage roller 16 may be easily mounted to and released from the bearings by elastically deforming the bearings, or the massage roller, or both.

Shown in FIGS. 8 to 12 is a massage roller 16 according to a second embodiment. This embodiment differs from the first embodiment discussed above with reference to FIGS. 3 to 7 essentially in that each of the massaging members 28 to 43 is an elliptical disc, as is best seen from FIG. 11. More specifically, each elementary massaging member, e.g. the elementary massaging member 28, has a ellipse-shaped projection on a plane perpendicular to the longitudinal axis 22, the ellipse having a major axis and a minor axis measuring respectively 5.1 mm and 4.6 mm. Thus, as the massage roller 16 is rolled on the skin, the distance between the longitudinal axis 22 and the skin varies as a result of the elliptical contours of the elementary massaging members 28 to 43, thus causing additional forces which stimulate the skin.

Figure 16:
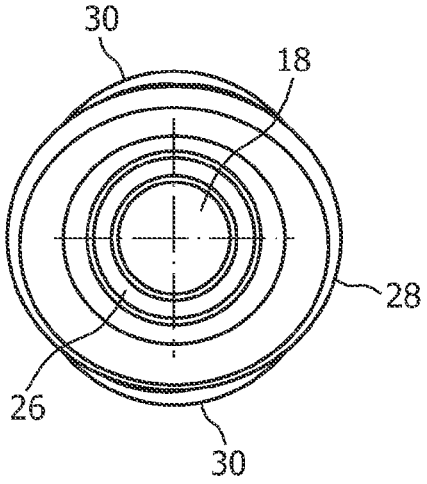
FIG. 16 is a side view of the massage roller shown in FIG. 13.
Figure 17:
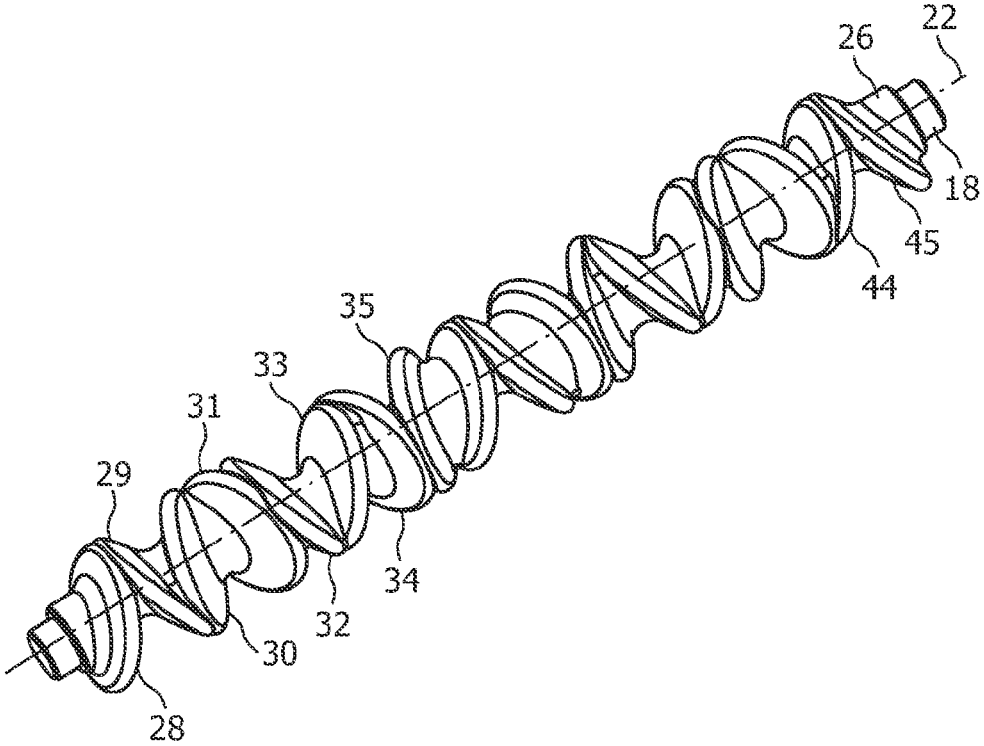
FIG. 17 is an oblique view of the massage roller shown in FIG. 13.

Turning now to FIGS. 13 to 17, there is shown a third embodiment of a massage roller 16. The massage roller 16 has a longitudinal axis 22 and comprises pairs 28-29, 30-31, 32-33, 34-35, 36-37, 38-39, 40-41, 42-43, and 44-45 of elementary massaging members 28 to 45 positioned in a V-shape relative to each other. Considering for example the pair 28-29, this pair comprises a first elementary massaging member 28 and a second elementary massaging member 29 rotated relative to the first member 28 through 180° about the longitudinal axis 22. Each of the elementary massaging members 28 to 45 is an elliptical disc. Due to adjacent pairs being rotated relative to each other through 90° about the longitudinal axis 22, the projection of the wave roller 16 on a plane perpendicular to the longitudinal axis 22 is not an ellipse but a superposition of two ellipses rotated relative to each other through 90°, as is best seen in FIG. 16. This also means that when the roller 16 is rolled on a plane surface such as tightened skin, none of the elementary massaging members 28 to 45 remains permanently in contact with the skin during an entire revolution of the massage roller 16. More specifically, each elementary massaging member contacts the skin twice during one revolution of the massage roller 16. This contacting is expected to be particularly efficient for dampening pain during an epilation session.

Figure 18:
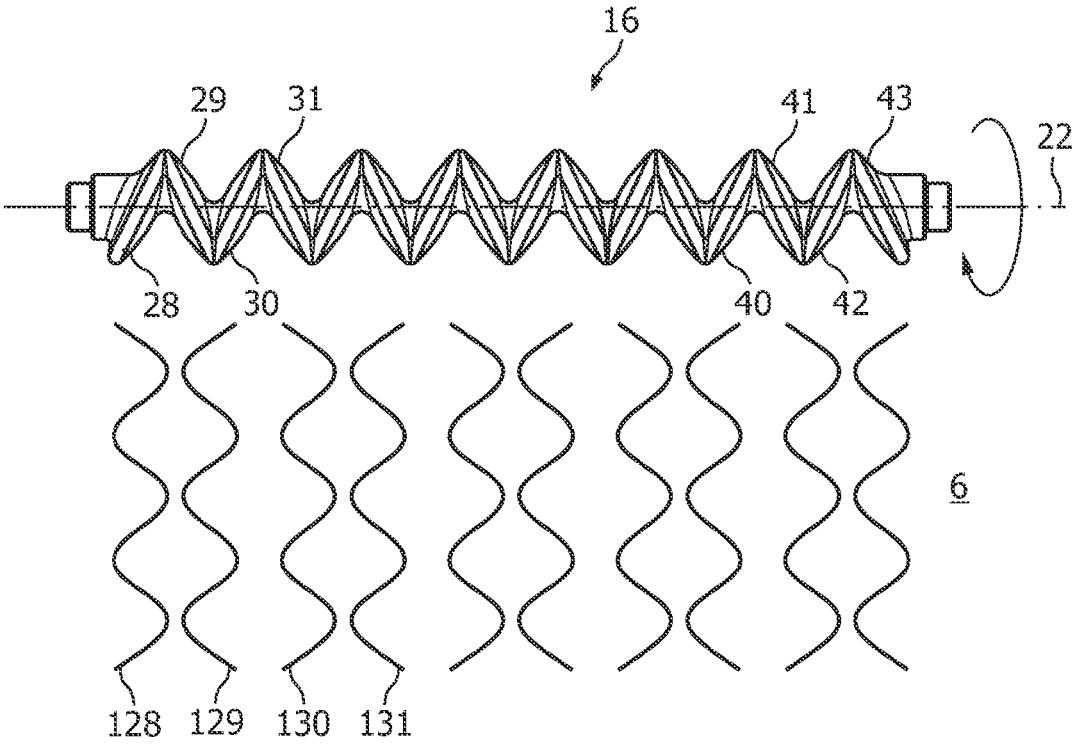
FIG. 18 schematically illustrates a massage roller and the axial variation of its instantaneous skin contact surface as the roller is rolled across the skin.

Turning now to FIG. 18, there is illustrated in a simplified manner the interaction of a massage roller 16 and skin 6 as the massage roller 16 is rotated on the skin 6 about its longitudinal axis 22. The line or narrow surface 128 is that part of the skin 6 which is contacted by the elementary massaging member 28 as the massage roller 16 rolls over the skin 6. The wave-like shape of the surface 128 arises from the fact that the elementary massaging member 28 has an instantaneous skin contact surface the axial extension of which (i.e. its extension along the longitudinal axis 22) varies as the massage roller 16 is rolled across the skin. The surface 128 being continuous is due to the fact that the elementary massaging member 28 remains in contact with the skin 6 during an entire revolution of the massage roller 16. Similar wave-like surfaces 129, 130, and 131 are associated with the elementary massaging members 29, 30, and 31. It is pointed out that the Figure is a simplistic representation, the shown dimensions of the surfaces 128 to 131 not exactly matching the shown dimensions of the massage roller 16. It is further noted that the pattern of surfaces 128 to 129 corresponds to the first or second embodiments of a wave roller 16, discussed above with reference to FIGS. 3 to 7 and 8 to 12. A massage roller according to the third embodiment, discussed above with reference to FIGS. 13 to 17, yields an analogous yet different pattern, with discontinuous surfaces.

While the invention has been illustrated and described in detail in, respectively, the drawings and the foregoing description, the drawings and the description are to be considered exemplary and not restrictive. The invention is not limited to the disclosed embodiments. Equivalents, combinations, and modifications not described above may also be realized without departing from the scope of the invention.

The verb "to comprise" and its conjugations does not exclude the presence of other steps or elements, and the indefinite article "a" or "an" does not exclude a plurality. It is also noted that a single unit may provide the functions of several means mentioned in the claims. The mere fact that certain features are recited in mutually different dependent claims does not indicate that a combination of these features cannot be used to advantage. Any reference signs in the claims should not be construed as limiting the scope.

The invention claimed is:

1. An epilator comprising:

an epilation head; and a massage roller arranged next to the epilation head, wherein the massage roller is rotatable about a longitudinal axis and comprises pairs of first and second elementary massaging members, each of the first and second elementary massaging members being a disc having a normal axis;

wherein, for each pair of the first and second elementary massaging members, the normal axis of the first elementary massage member is at a first angle with the longitudinal axis, and the normal axis of the second elementary massage member is at a second angle with the longitudinal axis, and an edge of the first elementary massage member is joined to an edge of the second elementary massage member, such that the first and second elementary massaging members from a V-shape relative to each other when viewed from a direction perpendicular to the longitudinal axis and an angle of the V-shape being determined by the first and second angles.

2. The epilator as claimed in claim 1, wherein the elementary massaging members are arranged in a row along the longitudinal axis.

3. The epilator as claimed in claim 1, wherein each elementary massaging member is a round, elliptical, or polygonal disc.

4. The epilator as claimed in claim 3, wherein a normal axis of each disc and the longitudinal axis enclose an angle between 5 degrees and 85 degrees.

5. The epilator as claimed in claim 1, wherein the pairs are arranged in positions which are mutually rotated about the longitudinal axis.

6. The epilator as claimed in claim 1, wherein a skin contact surface of each elementary massaging member is smooth.

7. The epilator as claimed in claim 1, wherein each elementary massaging member has an instantaneous skin contact surface and an axial extension, wherein the axial extension varies as the roller is rolled across a skin.

8. The epilator as claimed in claim 7, wherein the instantaneous skin contact surface is non-vanishing.

9. The epilator as claimed in claim 1, wherein a projection of the massage roller on a plane containing the longitudinal axis is wave-shaped or zig-zag-shaped.

10. The epilator as claimed in claim 1, wherein the massage roller is an injection moulded piece or comprises a rigid inner structure covered by an elastic material.

11. The epilator as claimed in claim 1, wherein the epilator comprises a reversibly detachable cap surrounding a portion of the epilation head and wherein the massage roller is mounted to the cap.

12. The epilator as claimed in claim 1, wherein the massage roller is spring-biased toward a skin.

13. The epilator as claimed in claim 1, wherein the epilator comprises a driving mechanism for driving the massage roller.

14. The epilator as claimed in claim 1, wherein the massage roller is reversibly detachable from the epilator.

15. An epilator comprising:

an epilation head; and a massage roller arranged next to the epilation head and being rotatable about a longitudinal axis, wherein a projection of the massage roller on a plane perpendicular to the longitudinal axis is a superposition of two ellipses rotated relative to each other by 90 degrees.

16. The epilator of claim 15, wherein the massage roller comprises massaging members, each massaging member contacting a skin twice during one revolution of the massage roller.

* * * * *